US006799954B2

(12) United States Patent
Ikegami et al.

(10) Patent No.: US 6,799,954 B2
(45) Date of Patent: Oct. 5, 2004

(54) TAPPET TURNING-PREVENTION STRUCTURE FOR FUEL SUPPLY APPARATUS

(75) Inventors: Tatsuya Ikegami, Tokyo (JP); Takuya Uryu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/195,526

(22) Filed: Jul. 16, 2002

(65) Prior Publication Data

US 2003/0059321 A1 Mar. 27, 2003

(30) Foreign Application Priority Data

Sep. 27, 2001 (JP) ..... 2001-297491

(51) Int. Cl.[7] ..... F04B 19/22

(52) U.S. Cl. ..... 417/470; 92/129; 92/140; 92/72

(58) Field of Search ..... 417/470; 92/129, 92/140, 72

(56) References Cited

U.S. PATENT DOCUMENTS 5,884,608 A * 3/1999 Cooke ..... 123/495
6,216,583 B1 * 4/2001 Klinger et al. ..... 92/129
6,302,659 B1 * 10/2001 Parker et al. ..... 417/273
6,431,842 B1 * 8/2002 Furuta ..... 417/273

FOREIGN PATENT DOCUMENTS

| | | |
|---|---|---|
| JP | 01-071169 | 5/1989 |
| JP | 6-159192 | 6/1994 |
| JP | 11-210598 | 8/1999 |

* cited by examiner

*Primary Examiner*—Justine R. Yu
*Assistant Examiner*—Emmanuel Sayoc
(74) *Attorney, Agent, or Firm*—Sughrue Mion, PLLC

(57) ABSTRACT

A tappet turning prevention structure for a fuel supply apparatus includes a piston defining a fuel pressurizing chamber within the housing. A tappet disposed at one end of the piston has accommodated in it a roller driven by a cam of an engine and a roller supporting pin for transmitting a force from the cam to the piston. The tappet is housed by a bracket which has one or two grooves in an inner surface of it for supporting the roller supporting pin at one or both ends. The number of parts can be decreased because the turning prevention pin for the tappet and the roller supporting pin is a single common pin, and therefore the need of controlling of the press-fit loads is eliminated because no process for thrusting the tappet turning prevention pin into the outer circumference of the tappet is involved.

2 Claims, 4 Drawing Sheets

TAPPET TURNING-PREVENTION STRUCTURE FOR FUEL SUPPLY APPARATUS

BACKGROUND OF THE INVENTION

1. Field of the Invention

This invention relates to a tappet turning-prevention structure for a fuel supply apparatus for supplying fuel to a fuel injector in a cylinder injection type engine.

2. Description of the Related Art

FIG. 7 is a schematic view of a conventional fuel supply apparatus. In FIG. 7, a fuel supply apparatus 1 is arranged to be fitted in an unillustrated housing or the like of an engine, and is driven via a cam 28 that rotates at half rotational speed of the engine. A casing 2 of the fuel supply apparatus 1 is provided with unillustrated suction pipe and discharge pipe disposed therein. In addition, a cylindrical concaved housing section 3 is formed in the fuel supply apparatus in the downward section in FIG. 7.

A sleeve 5 having a cylinder section 4 is disposed within the concaved housing section 3. The sleeve 5 is disposed in the manner in which one end thereof faces toward a bottom 3*a* of the concaved housing section 3. The sleeve 5 comprises the hollow cylindrical cylinder section 4, a thick section 6 being formed by thickening a part of a bottom 4*a* of the cylinder section 4, and a securing section 8 being formed into the shape of a flange at the edge of the bottom 4*a* of the cylinder section 4.

A substantially cylinder-shaped piston 9 is disposed within the cylinder section 4 of the sleeve 5 in a way allowing its reciprocating motion. The piston 9 comprises a fuel pressurizing chamber 10 together with the cylinder section 4. A compression coil spring 11 is compressedly housed within the fuel pressurizing chamber 10. The compression coil spring 11 is held in place by a spring holder 12.

Disposed around the sleeve 5 is a housing 13 surrounding the sleeve 5. The housing 13 having the form of a substantially bottomless cup is provided with a cylinder-shaped flange section 13*a* at the outer circumference thereof. A holder 14 is fastened to the piston 9 at the end opposite to the side where the fuel pressurizing chamber 10 is formed. Bellows 15 made of metal are disposed between the housing 13 and the holder 14. The bellows 15 serve as a receptacle for fuel leaking out of the space between the piston 9 and the sleeve 5.

A tappet 16, or a driving member, having the form of a bottomed cylinder is abutted against the piston 9 at the end opposite to the side where the fuel pressurizing chamber 10 is formed. The tappet 16 comprises a cam roller 18 rotatably supported by a roller-supporting pin 17. The cam roller 18 is brought into contact with the cam surface of the cam 28. A spring holder 19 is fastened to the tappet 16, and a compression coil spring 20 is compressively mounted in a space between the spring holder 19 and the housing 13.

A bracket 21 is disposed around the compression coil spring 20 for the purpose of fastening the fuel supply pump 1 to an unillustrated housing and the like of an engine. The bracket 21 is substantially cylinder-shaped and has a flange section 21*a* formed therein at about half its height. The flange section 21*a* is provided with a plurality of unillustrated holes that pierce the flange section and are formed along its circumference at predetermined positions. The casing 2 is provided with unillustrated internally threaded holes in the positions corresponding to the unillustrated through holes. Bolts are inserted in the unillustrated through holes and are fastened to the unillustrated internal threaded holes. Thus, the bracket 21 is firmly attached to the casing 2. With the outer circumference of the bracket 21 being supported, the fuel supply pump 1 is fastened to an unillustrated housing and the like of an engine.

In a high-pressure fuel supply pump thus composed, piston 9 is pushed toward the tappet 16 by the compression coil spring 11. The tappet 16 on the other hand is pushed by the compression coil spring 20 so that it is always in contact with the cam 28. Thus, upon receiving force generated by the rotations of the cam 28, the piston 9 reciprocates within the cylindrical section 4.

In a conventional fuel supply apparatus having a construction as above described, as shown in FIGS. 7 and 8, the tappet 16 that faces toward the rotating cam 28 when the fuel supply pump is mounted to the housing or the like of the unillustrated engine and that is provided with the cam roller 18 driven by the cam 28 and transmits the motion of the cam 28 to the piston 9, and the arrangement for preventing the tappet 16 from turning about the axis of the piston is such that the pin 25 press-fitted into the outer circumference surface of the tappet 16 is brought into a loose engagement with a groove formed in the inner surface of the bracket 21 accommodating the tappet 16.

In the tappet turning prevention structure in a fuel supply apparatus having a construction as above described, however, the tappet 16 is provided with the pin 25 press-fitted in the outer circumference of the tappet 16 and a roller supporting pin 17 as functionally separate parts, and so both the process for press-fitting the pin 25 into the outer circumference of the tappet 16 and the process for positioning the cam roller 18 and the roller-supporting pin 17 in relation to the tappet 16 by a snap ring 27 that fits in both the inside slot formed within the tappet 16 and the outside slot formed at the outer circumference of the roller supporting pin 17 are involved in the tappet 16 assembly process.

Because the tappet 16 is provided with both the roller supporting pin 17 and the pin 25 press-fit in the outer circumference of the tappet 16, the number of parts is not small. In addition, because a slot into which the tappet turning-prevention pin 25 is press-fitted must be formed in the tappet 16, the number of processing stages is increased. Further, it is necessary to control the pressure load during the press-fitting the pin 25 into the outer circumference of the tappet 16 for the purpose of eliminating the deformation of the tappet 16.

Furthermore, because the pin 25 press-fit into the outer circumference of the tappet 16 and the roller supporting pin 17 are at right angles to each other within the tappet 16, the tappet 16 can be assembled only from a certain limited direction due to the shape of the bracket.

SUMMARY OF THE INVENTION

The present invention has been made to solve the problems discussed above and has as its object the provision of a tappet turning prevention structure in a fuel supply apparatus that requires lesser numbers of parts, part processing stages and items to be controlled in the assembly process and provides a larger degree of freedom of part assembling in the assembly process.

With the above object in view, the present invention resides in the tappet turning prevention structure in a fuel supply apparatus that comprises a piston disposed within the cylindrical section in a manner allowing its reciprocating motion and defining a fuel pressurizing chamber together with the cylindrical section. A tappet is disposed at one end of the piston opposite to the fuel pressurizing chamber and having accommodated therein a roller driven by a cam of an engine and a roller supporting pin for rotatably supporting the roller for transmitting a force of the cam to the piston. The tappet is housed by a bracket fastened to the casing for allowing a reciprocating motion, and the bracket has a groove in an inner surface thereof for allowing an end portion of the roller supporting pin to engage therein.

Thus, the number of parts can be decreased because the turning prevention pin for the tappet and the roller supporting pin have been integrated as a single common part, and therefore the need of controlling of the press-fit loads is eliminated because no process for thrusting the tappet turning prevention pin into the outer circumference of the tappet is involved.

The bracket may have two grooves in an inner surface thereof for allowing the roller supporting pin is engaged by the grooves at both opposing end.

DESCRIPTION OF THE PREFERRED EMBODIMENTS

Figure 1:
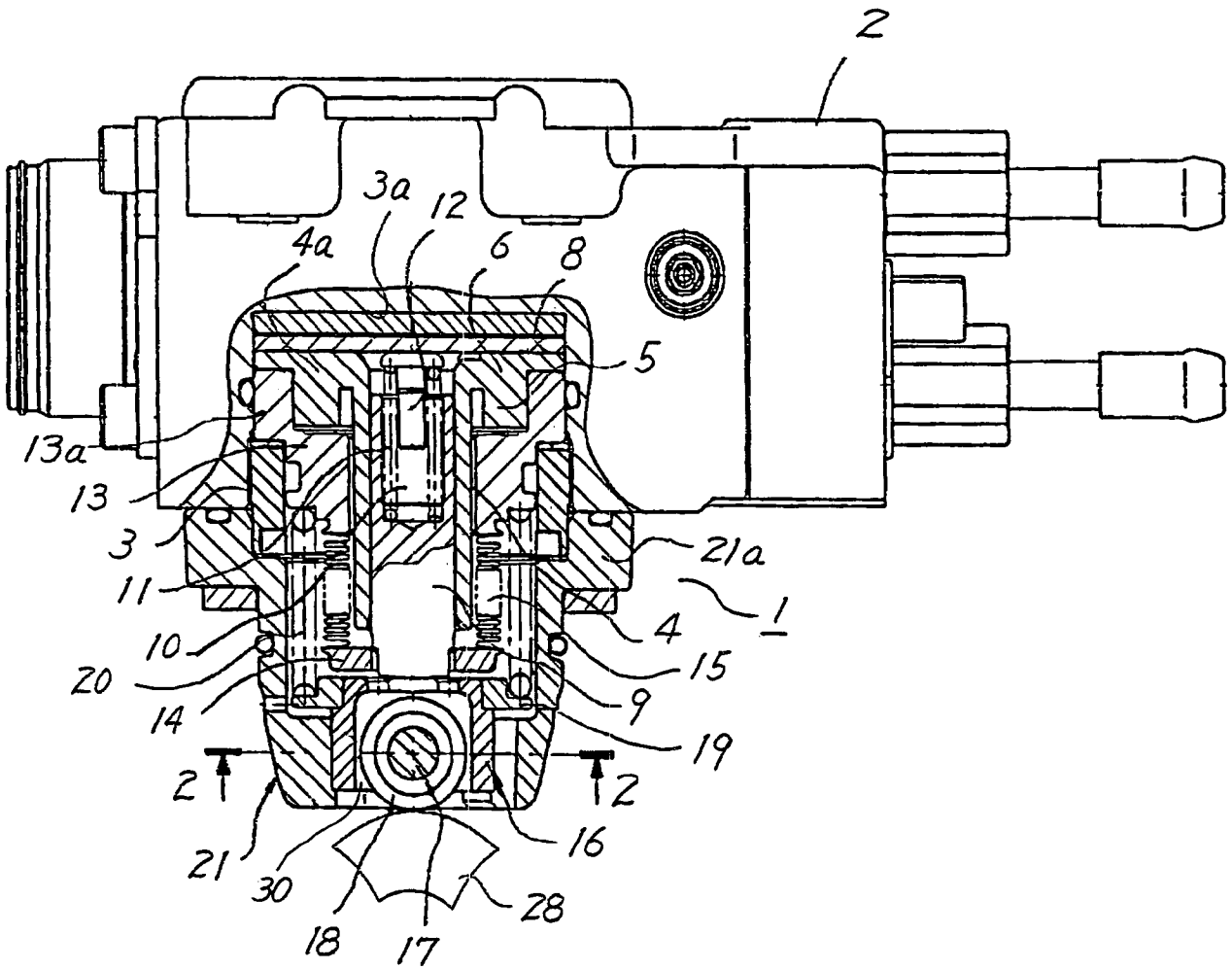
FIG. 1 is a schematic view showing the fuel supply apparatus according to the present invention.
Figure 2:
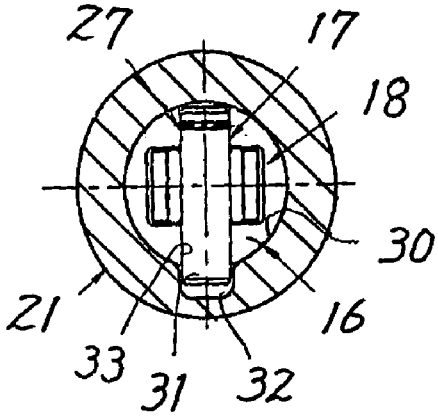
FIG. 2 is a sectional view taken along line 2—2 of FIG. 1 and showing a tappet turning prevention structure of one embodiment of the present invention.

FIG. 1 is a general view of a fuel supply apparatus including the tappet turning prevention structure according to the present invention, and FIG. 2 is a sectional view taken along line 2—2 of FIG. 1 of the tappet turning prevention structure. In FIG. 1, a tappet 16, or a driving force transmitting device, is a substantially cylindrical member and abuts against the piston 9 at the end opposite to the side where the fuel pressurizing chamber 10 is defined. The spring holder 19 is fastened to the tappet 16, and the compression coil spring 20 is compressively disposed in the space between the spring holder 19 and the housing 13. The compression coil spring 20 pushes the tappet 16 to a cam so that the tappet 16 is continuously brought into engagement with the cam 28. The piston 9 is urged to the tappet 16 by the compression coil spring 11. Thus, the tappet 16 can drive the piston 9 by the stroke corresponding to the eccentric distance of the cam 28, and the piston 9, upon being driven, supplies fuel by making reciprocating motion within the cylinder section 4. The piston 9 and the tappet 16 are encircled and held by a bracket 21 that is firmly attached to the casing 2 via bolts. The bracket 21 holds the tappet 16 by engaging the cylindrical outer circumference thereof and also by holding its end opposite to the side facing the piston 9 so that the piston 9 and the tappet 16 are not pushed out of the housing 13 by the compression coil spring 11 and the compression coil spring 20.

In FIGS. 1 and 2, the substantially cylindrical tappet 16 is provided with a hollow space 30 that is formed by carving in from the end of the tappet 16 facing to the cam 28 to have a dimension and shape for accommodating the cam roller 18. In addition, a pin hole 33 is formed in the tappet 16 for accepting a roller supporting pin 17 for holding the cam roller 18 in the hollow space 30 in the manner in which the cam roller 18 can rotate and also contacts against the cam 28. A snap ring 27 is disposed for fitting elastically into both the circumferential groove formed at one end of the roller supporting pin 17 and the circumferential groove formed at the inner circumference of the pin hole 33 in the corresponding position so that the roller supporting pin 17 does not come off from the pin hole 33.

According to the present invention, one end of the roller supporting pin 17 protrudes from the cylindrical surface of the tappet 16 to form a protruding end 31. The protruding end 31 is loosely fitted in a positioning groove 32 that is formed axially in the inner circumference of the bracket 21 supporting the tappet 16 and has a substantially U-shaped cross section. The tappet 16 is therefore supported within the bracket 21 in the manner in which it cannot rotate around the axis of the piston 9, although it can move freely along the axis of the piston 9 (the direction of movement of the tappet 16).

In the tappet turning prevention structure which has the construction like this, it is possible to reduce the number of parts because the turning prevention pin for the tappet 16 and the roller supporting pin 17 has been integrated as a common part. In addition, the need of controlling of the press-fit loads is eliminated because no process for thrusting the tappet turning prevention pin 25 into the outer circumference of the tappet 16 is involved.

Embodiment 2

Figure 3:
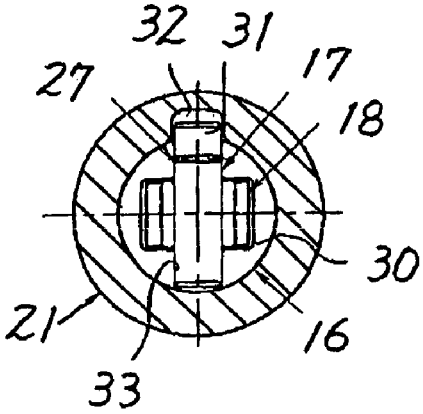
FIG. 3 is a view showing a tappet turning prevention structure of the second embodiment of the present invention.

FIG. 3 is a view showing a tappet turning prevention structure as the second embodiment of the present invention. In FIG. 3, the roller supporting pin 17 that serves within the bracket 21 for the tappet turning prevention extended toward the snap ring 27 side to form the protruding end 31 in this embodiment, and the protruding end 31 is loosely fitted within the positioning groove 32 formed axially in the inner circumference of the bracket 21 supporting the tappet 16 and having a substantially U-shaped cross section. The tappet 16 is therefore supported within the bracket 21 in the manner in which it cannot rotate about the axis of the piston 9, although it can move freely in the direction of the axis of the piston 9 (the direction of movement of the tappet 16), similarly in the case of first embodiment.

Embodiment 3

Figure 4:
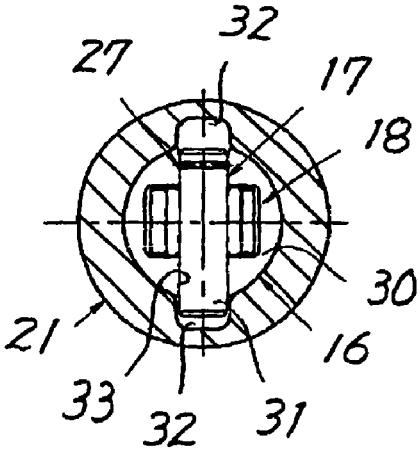
FIG. 4 is a view showing a tappet turning prevention structure of the third embodiment of the present invention.

FIG. 4 is a view showing a tappet turning prevention structure of the third embodiment of the present invention. In FIG. 4, one additional positioning groove 32 formed axially in the inner circumference of the bracket 21 and having a substantially U-shaped cross section for accepting the protruding end 31 formed by extending one end of the roller supporting pin 17 is formed in the inner surface of the bracket 21 in the position causing the second groove to locate at the opposite side of the first slot in this embodiment. Thus, the direction along which the tappet 16 is fitted in the bracket 21 is changeable by 180 degrees, thus increasing the degree of freedom of the fitting of the tappet 16 in the bracket 21.

Embodiment 4

Figure 5:
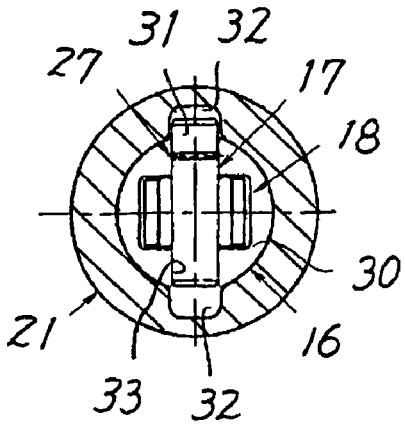
FIG. 5 is a view showing a tappet turning prevention structure of the fourth embodiment of the present invention.

FIG. 5 is a view showing a tappet turning prevention structure of the fourth embodiment of the present invention.

In FIG. 5, one additional positioning groove 32 formed axially in the inner circumference of the bracket 21 and having a substantially U-shaped cross section for accepting the protruding end 31 formed by extending one end of the roller supporting pin 17 is formed in the inner surface of the bracket 21 in the position causing the second groove to locate at the opposite side of the first groove as in the case of the third embodiment. What differs from the third embodiment in this embodiment is that the protruding end 31 being formed by extending one end of the roller supporting pin 17 for fitting into the positioning slot 32 having the U-shaped cross section is formed on the same side as the side where the snap ring 27 is provided in this embodiment, although the protruding end 31 in the third embodiment is formed at the opposite side of the snap ring 27 of the roller supporting pin 17. The advantageous effect of this embodiment is same as that of the third embodiment.

Embodiment 5

Figure 6:
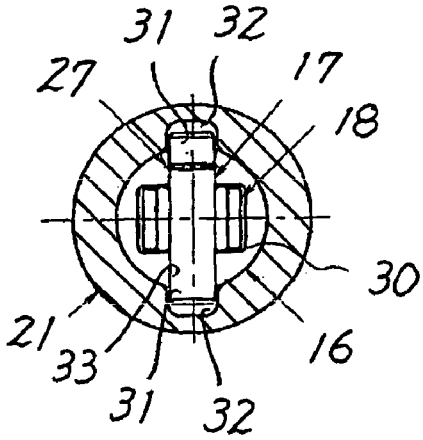
FIG. 6 is a view showing a tappet turning prevention structure of the fifth embodiment 5 of the present invention.
Figure 8:
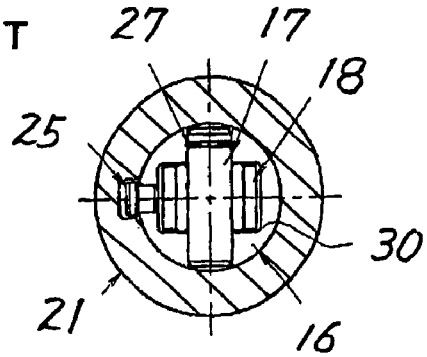
FIG. 8 PRIOR ART
FIG. 8 is a sectional view taken along line 1—1 of FIG. 7 and showing a tappet turning prevention structure of a conventional fuel supply apparatus.
Figure 7:
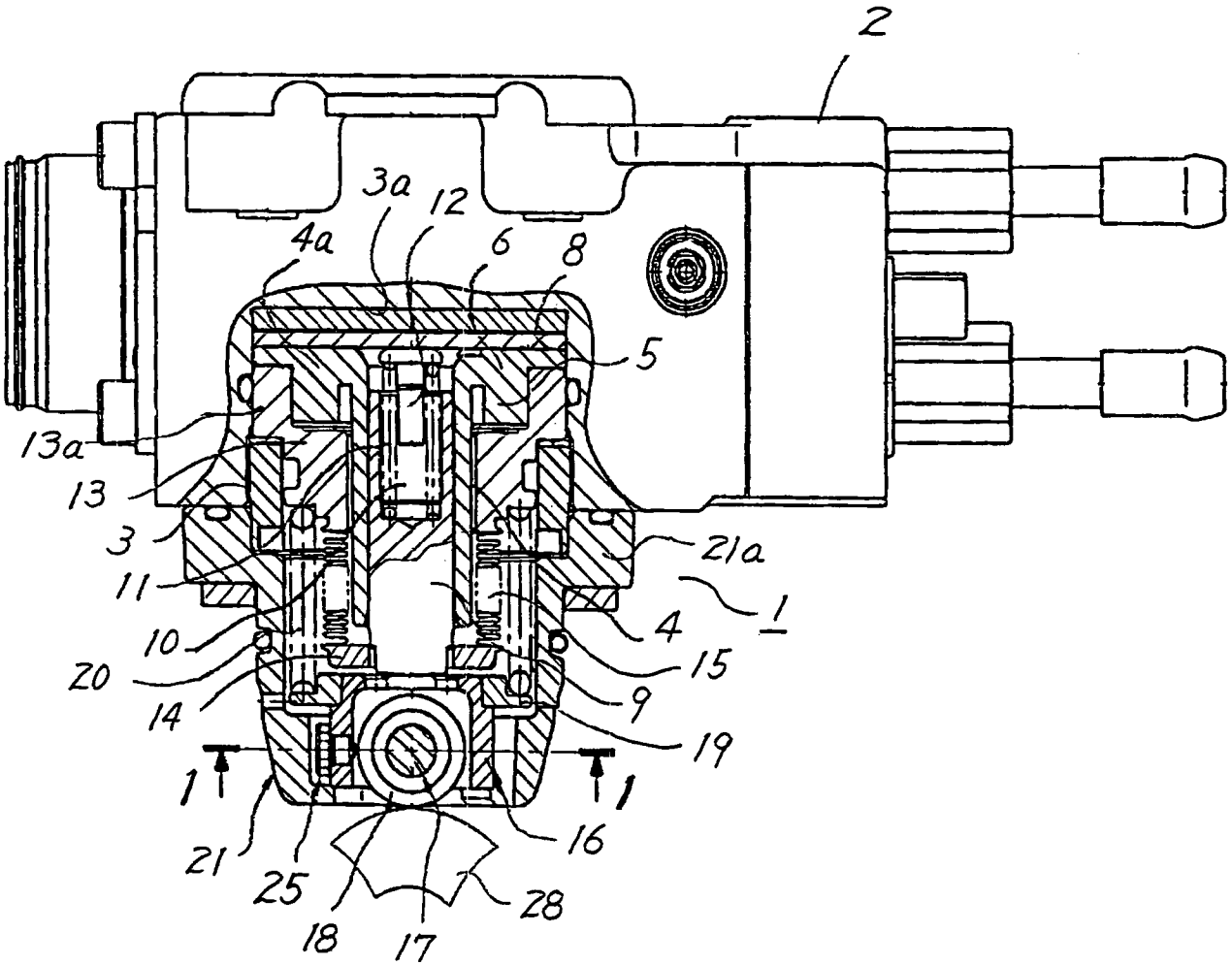
FIG. 7 PRIOR ART
FIG. 7 is a general view showing a conventional fuel supply apparatus.

FIG. 6 is a view showing a tappet turning prevention structure of the fifth embodiment of the present invention. In FIG. 6, one additional positioning slot groove formed axially in the inner circumference of the bracket 21 and having a substantially U-shaped cross section for accepting the protruding end 31 formed by extending one end of the roller supporting pin 17 is formed in the inner surface of the bracket 21 in the position causing the second groove to locate at the opposite side of the first groove as in the case of the third and the fourth embodiments. What differs from third and the fourth embodiments in this embodiment is that the protruding end 31 being formed by extending one end of the roller supporting pin 17 for fitting in the positioning groove 32 having U-shaped cross section is formed on both sides in this embodiment, although the protruding end 31 is formed at only one side in the third and the fourth embodiments. The advantageous effect of this embodiment is same as that of the third and the fourth embodiments.

As has been described, the tappet turning prevention structure in a fuel supply apparatus comprises a casing having formed therein a suction passage through which fuel is sucked in, a discharge passage through which fuel is discharged and a cylindrical concaved housing section, and a sleeve having a cylinder-shaped cylindrical section and a flange-shaped mounting section disposed at one end of the cylindrical section, said sleeve being disposed with one end of the mounting section abutting against the bottom of said concaved housing section. A piston is disposed within said cylindrical section in a manner allowing its reciprocating motion and defining a fuel pressurizing chamber together with said cylindrical section. A tappet disposed at one end of said piston opposite to said fuel pressurizing chamber and having accommodated therein a roller driven by a cam of an engine and a roller supporting pin for rotatably supporting said roller for transmitting a force of said cam to said piston, and a bracket is fastened to said casing and housing said tappet for allowing a reciprocating motion of said tappet. The bracket has a groove in an inner surface thereof for allowing an end portion of said roller supporting pin to engage therein. Therefore, the number of parts can be decreased because the turning prevention pin for the tappet and the roller supporting pin have been integrated as a single common part, and therefore the need of controlling of the press-fit loads is eliminated because no process for thrusting the tappet turning prevention pin into the outer circumference of the tappet is involved.

What is claimed is:

1. A tappet turning prevention structure in a fuel supply apparatus comprising:

a casing having formed therein a suction passage through which fuel is sucked in, a discharge passage through which fuel is discharged and a cylindrical concaved housing section;

a sleeve having a cylinder-shaped cylindrical section and a flange-shaped mounting section disposed at one end of the cylindrical section, said sleeve being disposed with one end of the mounting section abutting against the bottom of said concaved housing section;

a piston disposed within said cylindrical section in a manner allowing its reciprocating motion and defining a fuel pressurizing chamber together with said cylindrical section;

a tappet disposed at one end of said piston opposite to said fuel pressurizing chamber and having accommodated therein a roller driven by a cam of an engine and a roller supporting pin for rotatably supporting said roller for transmitting a force of said cam to said piston; and a bracket fastened to said casing and housing said tappet for allowing a reciprocating motion of said tappet;

wherein said bracket has a groove in an inner surface thereof for allowing an end portion of said roller supporting pin to engage therein.

2. A tappet turning prevention structure of a fuel supply apparatus as claimed in claim 1, wherein said bracket has two grooves in an inner surface thereof for allowing end portions of said roller supporting pin to engage at positions opposite to each other.

* * * * *